US008540357B2

(12) United States Patent
Mantell et al.

(10) Patent No.: US 8,540,357 B2
(45) Date of Patent: Sep. 24, 2013

(54) DITHERED PRINTING OF CLEAR INK TO REDUCE RUB AND OFFSET

(75) Inventors: David A. Mantell, Rochester, NY (US); Mojgan Rabbani, Pittsford, NY (US); Jule W. Thomas, Jr., West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 986 days.

(21) Appl. No.: 12/617,230

(22) Filed: Nov. 12, 2009

(65) Prior Publication Data

US 2011/0111125 A1 May 12, 2011

(51) Int. Cl.
*B41J 2/01* (2006.01)

(52) U.S. Cl.
USPC ..... 347/99; 347/88; 347/103

(58) Field of Classification Search
USPC ..... 347/100, 95, 96, 88, 99, 102, 20, 347/21, 9, 105, 103; 106/31.6, 31.13, 31.27; 523/161, 160
See application file for complete search history.

(56) References Cited

U.S. PATENT DOCUMENTS 6,176,574 B1 * 1/2001 Wen et al. ..... 347/101
6,328,408 B1 * 12/2001 Gelbart ..... 347/102
6,428,157 B1 * 8/2002 Wen ..... 347/95
6,681,095 B1 1/2004 Tsuda
6,779,884 B1 * 8/2004 Ma et al. ..... 347/101
6,830,326 B2 * 12/2004 Tsao et al. ..... 347/98
6,854,840 B2 * 2/2005 Rao et al. ..... 347/105
6,925,281 B2 8/2005 Weber et al.
2002/0075370 A1 * 6/2002 Szlucha ..... 347/101
2007/0120922 A1 * 5/2007 Belelie et al. ..... 347/100
2008/0081116 A1 * 4/2008 Makuta et al. ..... 427/372.2
2008/0248196 A1 10/2008 Anderson et al.
2009/0237425 A1 9/2009 Lang
2009/0263172 A1 10/2009 Kovacs

* cited by examiner

*Primary Examiner* — Manish S Shah

(74) *Attorney, Agent, or Firm* — Maginot, Moore & Beck, LLP

(57) ABSTRACT

An imaging device includes a media supply and handling system configured to move media along a path. A printing system is disposed along the path that includes at least one printhead for applying melted phase-change ink of at least one color to the media to form images thereon. A fixing assembly is disposed along the path downstream of the printing system that is configured to apply heat and/or pressure to the melted phase change ink of the images on the media. A coating system is disposed along the path downstream from the spreader. The coating system includes at least one printhead for applying a clear ink on top of the images formed on the media by the printing station.

6 Claims, 1 Drawing Sheet

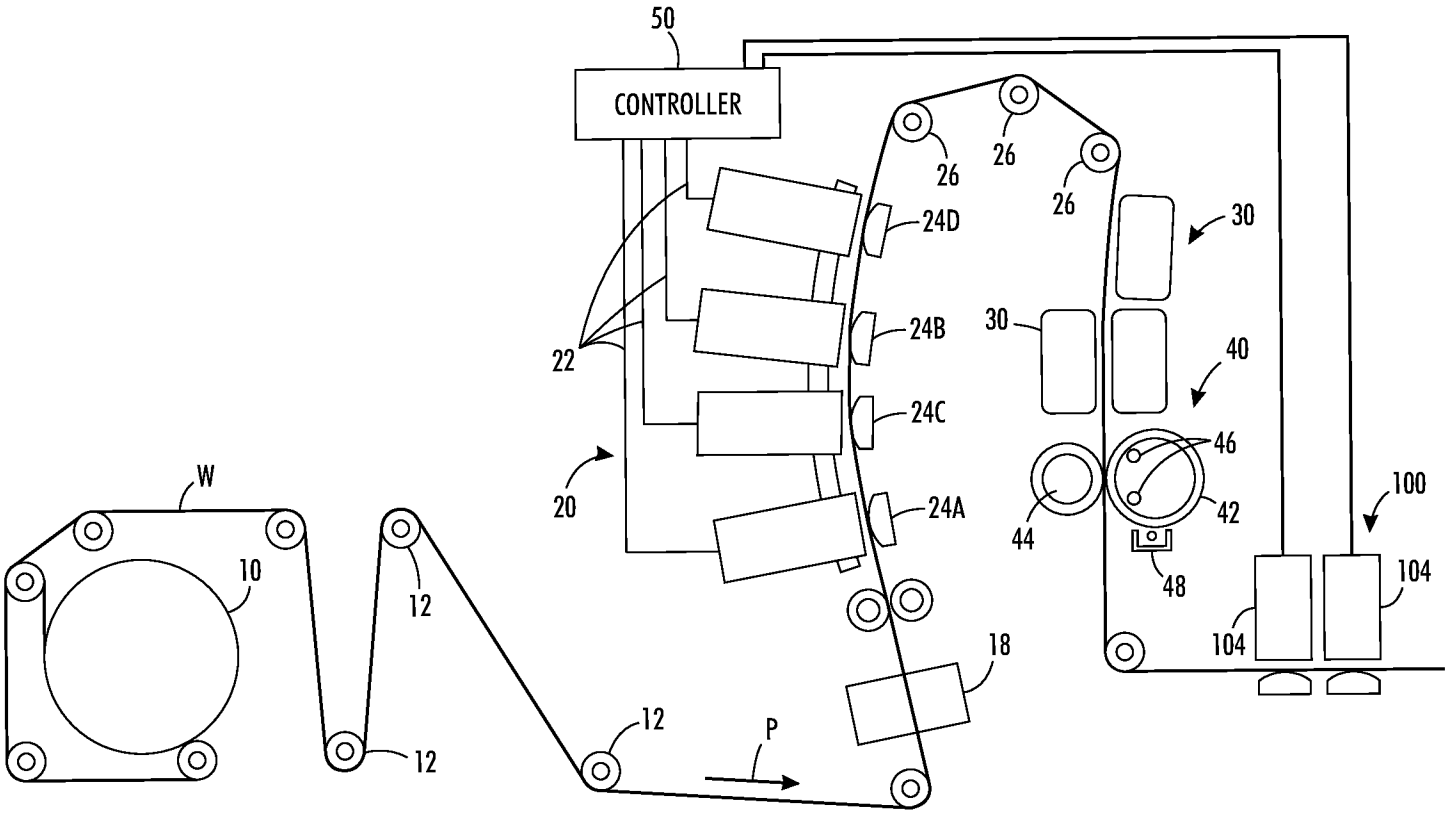
100
104
104
30
40
46
42
48
26
26
26
30
44
18
24D
24B
24C
24A
CONTROLLER
50
22
20
P
12
12
12
10
W

DITHERED PRINTING OF CLEAR INK TO REDUCE RUB AND OFFSET

TECHNICAL FIELD

The present disclosure relates to ink-jet printing, particularly involving phase-change inks printing on a substantially continuous web.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a media sheet or a media web. In a web printer, a continuous supply of media, typically provided in a media roll, is mounted onto rollers that are driven by motors. A loose end of the media web is passed through a print zone opposite the print head or heads of the printer. Beyond the print zone, the media web is gripped and pulled by mechanical structures so a portion of the media web continuously moves through the print zone. Tension bars or rollers may be placed in the feed path of the moving web to remove slack from the web so it remains taut without breaking.

In a typical phase change ink direct printing system, melted phase change ink is ejected from jets in the print head directly onto the final receiving web. In phase change ink continuous-web printing, a high pressure roller nip, also referred to as a spreader, is used after the melted phase change ink is jetted onto the web to spread the ink on the web to achieve the desired print quality. The function of the spreader is to take what are essentially isolated droplets of ink on web and smear them out to make a continuous layer by pressure and/or heat so that spaces between adjacent drops are filled and image solids become more uniform. Other methods of spreading or fixing ink are also possible such as with heat or pressure alone.

Two difficulties faced in imaging devices, and in particular, imaging devices that utilize phase change ink to form images, are ink rub and offset during handling of the prints. As used herein, ink rub refers to the smearing or scuffing of the ink of an image on a receiving substrate, such as a sheet of paper. Ink offset refers to ink from an image formed on a surface or portion of a surface of a receiving substrate being transferred to another surface or another portion of the substrate. Ink rub and offset is particularly a concern for applications that require extensive handling such as the outside of envelopes or printed sheets inserted into envelopes.

To prevent ink rub and/or offset, some previously known systems utilize a protective coating, such as varnish, applied over the printed image on the substrate to prevent or minimize ink rub or offset of the printed image. For example, a varnisher places a protective coating over the entire image in order to prevent ink rub and/or offset from the resulting prints. In some previously known systems, overlaying clear ink may require coverages greater than 50% because the act of spreading the ink in the spreader brings all of the ink to a common level and if the overlay of clear ink does not completely cover the colored ink, some of the colored ink may end up at the surface where it is susceptible to rub and offset. While high coverage clear coatings applied over images formed on a substrate may be useful to prevent or minimize ink rub or offset of the images, the addition of the clear coating material adds to the expense of the print, and the increased expense due to the coating is commensurate with the amount of coating used per print.

SUMMARY

The present disclosure proposes a system and method of protecting images formed on a media substrate from rub and offset using a coating station configured to apply a clear ink coating over images formed on the media after the images have been transfixed, fused, or spread onto the media substrate by applying pressure and or heat to the image. Applying the clear ink coating after the image has been transfixed to the substrate enables a coating having a smaller percentage of coverage to achieve the same protection performance or better than as a clear ink coating applied prior to colored ink being spread at the same time or transfixed at the same time. It is also preferable to printing with an ink that can be fused with a toner. Also it requires a lower coverage than a varnish of similar composition applied over the whole surface.

In particular, in one embodiment, an imaging device includes a media supply and handling system configured to move media along a path. A printing system is disposed along the path that includes at least one printhead for applying melted phase-change ink of at least one color to the media to form images thereon. A spreader is disposed along the path downstream of the printing system that is configured to apply pressure to the melted phase change ink of the images on the media. A coating system is disposed along the path downstream from the spreader. The coating system includes at least one printhead for applying a clear ink on top of the images formed on the media by the printing station.

In another embodiment, a method of using an imaging device comprises transporting media along a path. Melted phase change ink of at least one color is deposited on the media to form at least one image using a printing system having at least one printhead located along the path. Pressure and/or heat is then applied to the melted phase change ink of the at least one color using a fixing assembly located along the path downstream from the printing station. A clear ink is then deposited on top of the at least one image formed on the media by the printing system using a coating system having at least one printhead located along the path downstream from the spreader.

In yet another embodiment, a coating system for use with an imaging device is provided. The coating system comprises at least one printhead configured to emit clear ink. A controller is configured to cause the at least one printhead to emit the clear ink at a first dither level or a second dither level. The first and the second densities are each different from each other and each being less than 50% of the mass that can be printed of the colored inks.

BRIEF DESCRIPTION OF THE DRAWINGS

The FIGURE is a simplified view of an imaging device that includes a coating station positioned after the fixing assembly.

DETAILED DESCRIPTION

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an individual jet forms an inked line during imaging and is also the direction in which the substrate moves through the imaging device. The cross-process direction, along the same plane as the substrate, is substantially perpendicular to the process direction.

The FIGURE is a simplified view of a direct-to-sheet, continuous-media, phase-change ink printer. A media supply and handling system is configured to supply a very long (i.e., substantially continuous) web of media W of "substrate" (paper, plastic, or other printable material) from a media source, such as spool 10. The media web may be unwound as needed, and propelled by a variety of motors, not shown. A set of rolls 12 controls the tension of the unwinding media as the media moves through a path. In alternative embodiments, the media may be transported along the path in cut sheet form in which case the media supply and handling system may include any suitable device or structure that enable the transport of cut media sheets along a desired path through the imaging device.

Along the path there is provided a preheater 18, which brings the web to an initial predetermined temperature. The preheater 18 can rely on contact, radiant, conductive, or convective heat to bring the media to a target preheat temperature, which in one practical embodiment, is in a range of about 30° C. to about 70° C.

The media is transported through a printing station 20 including a series of printheads 21A, 21B, 21C, and 21D, each printhead effectively extending across the width of the media and being able to place ink of one primary color directly (i.e., without use of an intermediate or offset member) onto the moving media. As is generally familiar, each of the four primary-color images placed on overlapping areas on the media combine to form a full-color image, based on the image data sent to each printhead through image path 22 from controller 50. In various possible embodiments, there may be provided multiple printheads for each primary color; the printheads can each be formed into a single or multiple linear array or arrays; the function of each color printhead can be divided among multiple distinct printheads located at different locations along the process direction; or the printheads or portions thereof can be mounted movably in a direction transverse to the process direction P, such as for spot-color applications.

In one embodiment, the ink utilized in the imaging device 10 is a "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink.

Associated with each printhead is a backing member 24A-24D, typically in the form of a bar or roll, which is arranged substantially opposite the printhead on the other side of media. Each backing member is used to position the media so that the gap between the printhead and the sheet stays at a known, constant distance. Each backing member may be configured to emit thermal energy to aid in heating the media to a desired temperature which, in one practical embodiment, of about 40° C. to about 60° C. The preheater 18, the printheads, backing members 24 (if heated), as well as the surrounding air combine to maintain the web W in the printing zone 20 in a predetermined temperature range of about 40° C. to 70° C.

As the partially-imaged media moves to receive inks of various colors throughout the printing station 20, the temperature of the media is maintained within a given range. Ink is jetted at a temperature typically significantly higher than the receiving web's temperature which heats the surrounding paper (or whatever substance the media is made of). Therefore the members in contact with or near the media in zone 20 must be adjusted so that that the desired media temperature is maintained. For example, although the backing members may have an effect on the media temperature, the air temperature and air flow rate behind and in front of the media may also impact the media temperature. Accordingly, air blowers or fans may be utilized to facilitate control of the media temperature.

The media temperature is kept substantially uniform for the jetting of all inks from printheads in the printing zone 20. Depending on the thermal properties of the particular inks and the media, this media temperature uniformity may be achieved by preheating the media and using uncontrolled backer members, and/or by controlling the different backer members 24A-24D to different temperatures to keep the substrate temperature substantially constant throughout the printing station. Temperature sensors (not shown) associated with the media may be used with a control system to achieve this purpose, as well as systems for measuring or inferring (from the image data, for example) how much ink of a given primary color from a printhead is being applied to the media at a given time. The various backer members can be controlled individually, using input data from the printhead adjacent thereto, as well as from other printheads in the printing station.

Following the printing zone 20 along the media path are one or more "midheaters" 30. The midheater 30 can use contact, radiant, conductive, and/or convective heat to bring the media to the target temperature. The midheater 30 brings the ink placed on the media to a temperature suitable for desired properties when the ink on the media is sent through the spreader 40. In one embodiment, a useful range for a target temperature for the midheater is about 35° C. to about 80° C. The midheater 30 has the effect of equalizing the ink and substrate temperatures to within about 15° C. of each other. Lower ink temperature gives less line spread while higher ink temperature causes show-through (visibility of the image from the other side of the print). The midheater 30 adjusts substrate and ink temperatures to 0° C. to 20° C. above the temperature of the spreader, which is described below.

Following the midheaters 30, along the path of the media, is a fixing assembly 40 that is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIGURE, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the media. Either roll can include heat elements such as 46 to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roll temperature in spreader 40 is maintained at a temperature to an optimum temperature that depends on the properties of the ink such as 55° C.; generally, a lower roll temperature gives less line spread while a higher temperature causes imperfections in the gloss. Roll temperatures that are too high may cause ink to offset to the roll. In one practical embodiment, the nip pressure is set in a range of about 500 to about 2000 psi lbs/side. Lower nip pressure gives less line spread while higher may reduce pressure roll life.

The spreader 40 can also include a cleaning/oiling station 48 associated with image-side roll 42, suitable for cleaning and/or applying a layer of some lubricant or other material to the roll surface. Such a station coats the surface of the spreader roll with a lubricant such as amino silicone oil having viscosity of about 10-200 centipoises. Only small amounts of oil are required and the oil carry out by web W is only about 1-10 mg per A4 size page. In one possible embodiment, the midheater 30 and spreader 40 can be combined within a single unit, with their respective functions occurring relative to the same portion of media simultaneously. In another embodiment the media is maintained at a high temperature in the print zone to enable spreading of the ink as it is printed. The spreader is thus incorporated into the print zone as the ink is allowed to flow by extending the time it spends in the liquid state.

Following passage through the spreader 40 the printed media can be further processed such as by printing on the other side of the media (duplex printing). In embodiments in which the media is a web, the web may be rewound at a winder (not shown) or cut into sheets or pages. Cut sheet media may be directed to further finishing systems such as binders, collators, staplers, and the like. Different preheat, midheat, and spreader temperature setpoints can be selected for different types of ink and/or weights of web media.

Ink prints or images generated by an imaging device may suffer from two significant image quality issues. The first issue is that the ink images may be smeared by rubbing. The second is that ink can offset from inked areas to blank areas on the facing sheet or to other surfaces that the ink comes into contact with. These issues are particularly a concern when printing on the outside of envelopes and for folded sheets inserted into envelopes. One method that has been used to prevent or minimize ink offset and/or rub is to apply an overlay of clear ink on top of the image on the web. The overlay of clear ink acts as a sacrificial layer of ink that may be smeared and/or offset during handling without affecting the appearance of the image underneath.

In such previously known systems, the overlay of clear ink was applied over the entire surface with a varnisher, in order to prevent ink rub and/or offset from the resulting prints. While full or nearly full coverage clear coatings applied over images formed on a substrate may be useful to prevent or minimize ink rub or offset of the images, the addition of the clear coating material adds to the expense of the print, and the increased expense due to the coating is commensurate with the amount of coating used per print.

As an alternative to applying high coverage clear coatings or overlays to prevent ink rub and offset over images on the media prior to spreading the ink and coating at the spreader, the present disclosure proposes the adding a printhead assembly after the spreader for applying a dithered overlay of clear ink to an image on the media after the image has been transfixed to the media at the spreader so that the clear ink sits on top of the image and serve as a protection layer to the underlying image. Experiments have shown that if a clear ink coating is not squished, i.e., is not spread on the web by the spreader along with the colored ink, then a smaller percent coverage of the clear ink coating is needed to achieve the same performance as coating ink that has been squished, i.e., spread onto the web at the spreader. Even if the clear ink is subsequently spread it still remains predominantly on top of the colored ink and still provides improved protection In particular, experiments have found that approximately 30% coverage of clear ink remaining on top of the clear ink may protect against rub and only approximately 10% coverage of clear ink may protect against offset. By minimizing the amount of clear ink needed to protect against ink rub and offset, the clear ink usage does not have such a large impact on the cost per print.

Clear ink for the purposes of this disclosure is functionally defined as a substantially clear overcoat ink that has minimal impact on the final printed color, regardless of whether or not the ink is devoid of all colorant. In one embodiment, the clear ink may be quantified in that the color measurement difference between a print with an overcoat and the print without an overcoat is no more than a delta E ($\Delta E$) of 10. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

In one embodiment, following passage through the spreader 40, the printed media is guided past a coating station 100 which is configured to print a clear ink coating at selectable dither level or coverage levels to all or a portion of a printed media as it travels along the media pathway. As used herein, dither level or coverage level refers to a ratio or percentage of the portion of the receiving surface, i.e., printed media, that receives the clear ink relative to surface area of the receiving surface that does not receive the clear ink to form the coating. For example, different dither level coatings may be applied by halftoning or dithering the clear ink at select locations on the media. The image receiving surface of a print media is made up of a grid-like pattern of potential drop locations, sometimes referred to as pixels. As is known in the art, halftoning or dithering of the clear ink involves selectively depositing or not depositing drops of clear ink at each pixel location on the image receiving surface or localized areas of the image receiving surface. The percentage or fraction of the pixels that receive the clear ink versus the fraction of pixels that do not receive clear ink determines the dither or coverage level of the clear ink coating.

The coating system 100 is configured to apply a clear ink coating to all or select portions of the printed media at a first dither level selected to prevent or minimize ink rub and a second dither level selected to prevent or minimize ink offset. In one embodiment, the first dither level for the clear ink coating corresponds to a dither level of approximately 30%, and the second dither level for the clear ink coating corresponds to a dither level of approximately 10%. With reference to the FIGURE, the coating system 100 may include one or more printheads 104 that are configured to apply the ink at least the first and second dither levels to the printed media. Furthermore, the amount of clear ink at either of the levels can be varied depending on the image content over which the clear ink is deposited. That image content may include the coverage of the color ink and also might include the specific colors of the ink. In addition the amount of clear ink may be varied based on the colored in a small region that extends from a few to as much as 20 pixels from the colored ink.

In the embodiment shown in the FIGURE, the coating system 100 of the imaging device includes two printheads 104 each having a plurality of inkjet nozzles (not shown) for emitting the clear ink at the first or second dither levels onto the printed web. A single printhead or more than two printheads, however, may be used to apply the clear ink coating. The printheads 104 used in the coating system may be similar or identical to the type of printhead that is used to eject the colored ink. In another embodiment the method and materials of the printed image may be different from the printheads and the ink used to print the clear ink. In alternative embodiments, the coating system 100 may include a separate printhead for forming the first and the second dither level clear ink coatings on the web. The controller 50 is configured to generate driving signals to cause the inkjets of the respective printheads to eject the clear ink onto the printed web in timed registration with the printheads to form a clear ink coating at the first or second dither levels over images printed on the web by the printheads. Similar to the colored ink printheads, the printheads of the coating system 100 may include backing members 108, typically in the form of a bar or roll, arranged substantially opposite the printhead on the other side of the media. The backing members 108 of the coating system are used to position the media so that the gap between the printheads 104 and the media stays at a known, constant distance.

To facilitate the application of the clear ink coating over imaged areas, or select portions of imaged areas, on the media, the coating system 100 may be configured to apply the clear ink coating at either the first or second dither levels so that the clear ink coating overlaps the image area. As used herein, the term overlap in reference to the application of a clear ink coating refers to the formation of the coating over an image area or portion of the image area such that the coating extends beyond or outside the edges of the image area by a predetermined distance. Clear ink coatings may be applied to image areas so that they overlap the image areas by any suitable distance. In one embodiment, the overlap distance is less than or equal to approximately 1 mm although any suitable overlap distance may be used. Overlapping the clear ink coating over the images simplifies the coating process as precise registration is not required to ensure adequate coverage of image areas with the clear ink coating.

To enable the selective use of the clear coating system 100 to apply the clear ink coating at the desired coverage level, the imaging device controller 14 may configured to provide a clear coating option to users of the device and to allow the specification of desired coating level, e.g., 10% or 30% coverage. Such selections may be provided to a user or operator in any suitable manner such as through a user interface on the device (not shown) or remotely through a print engine installed on a computer or server.

While the embodiment depicted in the FIGURE shows the coating system positioned downstream from the fixing assembly 40, the coating station may be positioned near or in the print zone to form the clear ink coatings on the media during a second pass of the media through the print zone. For example, the media may be moved past the print zone to form the initial images on the media, then moved through the fixing assembly where heat and/or pressure are applied to the media to fix the images to the media. The media may then be looped back through to the print zone where the coating station deposits a clear ink coating onto the media. The images on the media upon which the clear ink coating has been applied may then bypass the fixing assembly. Alternatively, the media may then be moved through the fixing assembly for fixing the clear ink coating on top of the images on the media, such as by applying heat and/or pressure to the clear ink coating on the media, or spreading the clear ink of the coating with a spreader. Alternatively the clear ink can be applied in a second printing station.

As mentioned, the coating system for depositing a clear ink coating to media at the desired coverage level, such as 10% and 30%, may be used in imaging devices that form images on a continuous web of media or onto cut sheets of media. In addition, the coating system 100 may be used in imaging device that form images directly onto the media as described above or in imaging devices that utilize a transfix print process in which ink is first deposited onto an intermediate imaging member and subsequently transferred and fixed to the media. In addition, in some embodiments, the coating system 100 may be provided as an included component of the imaging device. Alternatively, the coating system 100 may be provided as a separate stand-alone system or module that may be added and removed from the media path of an imaging device in a suitable manner as needed.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

a media substrate;

a media supply and handling system configured to move the media substrate along a path;

a printing system disposed along the path, the printing system including at least one printhead for applying ink of at least one color to the media substrate to form images thereon;

a fixing assembly disposed along the path or downstream of the printing system, the fixing assembly being configured to apply at least one of pressure and heat to the ink on the substrate to fix the ink to the substrate;

a coating system disposed along the path downstream from the fixing assembly and printing system, the coating system including at least one printhead configured to maintain a melted clear phase change ink above a solid ink melting temperature and to eject the melted clear phase change ink on top of the images formed on the substrate by the printing system at a first coverage and a second coverage, the first coverage and the second coverage being different from each other and each coverage being less than 50% coverage; and a controller configured to actuate the at least one printhead of the coating system to eject the melted clear phase change ink at the first coverage or the second coverage.

2. The imaging device of claim 1, the first coverage being approximately 10% and the second coverage being approximately 30%.

3. A method of using an imaging device, the method comprising:

transporting media along a path;

depositing ink of at least one color on the media to form at least one image using a printing system having at least one printhead in a print zone located along the path;

applying at least one of pressure and heat to the ink of the at least one color using a fixing assembly; and ejecting a melted clear phase change ink on top of the at least one image formed on the media by the printing system using a coating system having at least one printhead located along the path downstream from the fixing assembly and print zone, the melted clear phase change ink being ejected onto the top of the least one image at a first coverage or a second coverage, the first coverage and the second coverage being different from each other and each coverage being less than 50% coverage.

4. The method of claim 3, the first coverage being approximately 10% and the second coverage being approximately 30%.

5. A coating system for use with an imaging device, the coating system comprising:

at least one printhead configured to maintain a melted clear phase change ink above a solid ink melting temperature and to eject the melted clear phase change ink on top of an image formed on an image receiving surface; and a controller configured to operate the at least one printhead to eject the melted clear phase change ink at a first coverage level or a second coverage level, the first coverage level and the second coverage level being different from each other and each coverage level being less than 50% coverage.

6. The coating system of claim 5, the first coverage level being approximately 10% and the second coverage level being approximately 30%.

* * * * *